US007527724B1

(12) United States Patent
Schucker

(10) Patent No.: US 7,527,724 B1
(45) **Date of Patent: *May 5, 2009**

(54) PROCESS FOR DESULFURIZATION OF HYDROCARBONS

(75) Inventor: Robert C. Schucker, The Woodlands, TX (US)

(73) Assignee: Trans Ionics Corporation, The Woodlands, TX (US)

( * ) Notice: Subject to any disclaimer, the term of this patent is extended or adjusted under 35 U.S.C. 154(b) by 168 days.

This patent is subject to a terminal disclaimer.

(21) Appl. No.: 11/551,340

(22) Filed: Oct. 20, 2006

Related U.S. Application Data

(60) Provisional application No. 60/737,575, filed on Nov. 17, 2005.

(51) Int. Cl.
*C10G 29/04* (2006.01)
*C10G 23/00* (2006.01)

(52) U.S. Cl. ..... 208/208 M; 208/14; 208/143; 208/209; 208/230; 208/232; 208/235

(58) Field of Classification Search ..... 208/14, 208/143, 208 M, 209, 230, 232, 235
See application file for complete search history.

(56) References Cited

U.S. PATENT DOCUMENTS 2,309,651 A * 1/1943 Birkhimer et al. ..... 208/232
7,192,516 B2 * 3/2007 Schucker ..... 208/208 M

* cited by examiner

*Primary Examiner*—Glenn Caldarola
*Assistant Examiner*—Prem C. Singh
(74) *Attorney, Agent, or Firm*—Winstead PC

(57) ABSTRACT

The present invention is a method of removing sulphur from a hydrocarbon feed stream, comprising the steps of:

(a) dissolving sodium in a liquid solvent to form a solution containing sodium atoms;

(b) combining the liquid solution from step (a) with a liquid hydrocarbon feed containing an organosulfur component to form a combined stream at a temperature of addition and at a pressure near or above the vapor pressure of the solvent at the temperature of addition;

(c) reacting the combined stream for sufficient reaction time and at sufficient reaction temperature to form a modified composition comprising one or more sulfur-containing species and less of the organosulfur species than had been present in the hydrocarbon feed;

(d) extracting a portion of the sulfur-containing species from the modified composition.

18 Claims, 2 Drawing Sheets

PROCESS FOR DESULFURIZATION OF HYDROCARBONS

This application claims the benefit under 35 USC 119(e) of U.S. provisional application No. 60/737,575, filed on Nov. 17, 2005, which is incorporated by reference herein in its entirety.

BACKGROUND OF THE INVENTION

1. Brief Description of the Invention

A method has been developed for the desulfurization of a liquid feeds containing organosulfur compounds using metallic sodium dissolved in liquid ammonia at a much lower temperature than previously thought possible.

2. Related Art

Recent regulations imposed by the Environmental Protection Agency have mandated the reduction in sulfur for on-road diesel fuel to 15 ppm S in the U.S. by June 2006; and refiners are currently installing technologies to meet this target. However, because on-road diesel fuel will be distributed through pipelines to customers across the country and because those pipelines will also be used to transport jet fuel and kerosene, which are substantially higher in sulfur, refiners will need to produce on-road diesel fuels having 6-7 ppm S. Even then, transport through the pipelines is expected to produce off-spec diesel (16-75 ppm S) as a result of mixing at the interfaces between the diesel and jet or kerosene. This off-spec diesel can be downgraded to the next lower quality fuel for the next four years resulting in a financial loss to the refiner. After 2010, no downgrades will be allowed. Therefore, there is a need for a process that can easily remove sulfur from distillate fuels, at the end of the pipeline or in refinery environments that can help refiners meet their low sulfur targets economically.

The literature describes several ways of removing sulfur from petroleum streams, which fall into two primary categories: (a) catalytic hydrotreating processes in which the feed is passed over a hydrotreating catalyst at elevated temperatures and hydrogen pressures and (b) non-hydrotreating processes. The present invention is an improved non-hydrotreating process.

Non-hydrotreating processes can be further divided into those that remove the entire sulfur-bearing molecule from the feed by adsorption onto a selective adsorbent, as exemplified by Khare (U.S. Pat. No. 6,274,533; U.S. Pat. No. 6,338,794 and U.S. Pat. No. 6,482,314), and those that remove only the sulfur by chemical reaction. The latter can further be divided into those that are oxidative in nature, as exemplified by Rappas (U.S. Pat. No. 6,402,940), Ohsol, et al (U.S. Pat. No. 5,985,137; U.S. Pat. No. 5,948,242), Yen (U.S. Pat. No. 6,402,939) and Gunnerman (U.S. Pat. No. 6,500,219), and those that are reducing in nature. The most important of the reducing processes is reaction of a feed containing organosulfur species with elemental sodium as exemplified by Brons, et al (U.S. Pat. No. 6,210,564), Baird (U.S. Pat. No. 4,003,824; U.S. Pat. No. 4,123,350) and Bearden (U.S. Pat. No. 3,787,315; U.S. Pat. No. 3,788,978; U.S. Pat. No. 3,791,966; U.S. Pat. No. 3,976,559 and U.S. Pat. No. 4,076,613).

In order to contact elemental sodium with feed, the sodium is typically melted (m.p.=97.8° C.) and added to the feed as a dispersion of small droplets. Even with intense mixing, it is not possible to produce extremely small droplet sizes. As a result, sodium on the surface of the droplets may react with sulfur in the feed to form a skin of sodium sulfide ($Na_2S$). This skin remains on the droplet exterior surface, and as $Na_2S$ has a melting point of 1,180° C., it remains as a solid under the conditions of desulfurization. The skin thereby inhibits further reaction between the sodium in the interior of the droplet and sulfur in the feed. For these reasons, it has been necessary in the prior art to use substantially higher ratios of sodium to feed sulfur than are stoichiometrically required in order to remove sulfur to the desired level.

Other methods to incorporate sodium include solvating sodium with ammonia, mixing with the feed stream and then reducing the pressure of the resulting liquid below the vapor pressure of ammonia to vaporize the ammonia solvent. This is disclosed in U.S. patent application Ser. No. 10/826,621, hereby incorporated by reference. This method is more economical and efficient than previous methods.

3. Summary of the Invention

In accordance with the present invention, a method of removing sulfur from liquid feeds is presented which overcomes limitations in the prior art. This invention is a method of removing sulfur from a liquid feed containing organosulfur compounds. The method, in the preferred embodiment, comprises the steps of:

(a) dissolving metallic sodium in a solvent to form a solution of sodium atoms;

(b) combining the resulting liquid solution of sodium with (1) a liquid hydrocarbon feed comprising organosulfur species and as an option, (2) a liquid hydrogen donor solvent to form a combined stream at a temperature of addition and at a pressure above the vapor pressure of the solvent at the temperature of addition;

(c) passing the feed to a pressurized reactor vessel;

(e) reacting the feed and sodium for sufficient time and at sufficient temperature to form a modified composition comprising one or more sulfur-containing species and less of the organosulfur species than had been present in the hydrocarbon feed;

(f) extracting the sulfur-containing products from the modified composition using an extraction fluid.

It is readily apparent to those skilled in the art that many different solvents, including but not limited to ammonia and some ethers, may be used to dissolve metallic sodium and that many different reactor and flow configurations may be used to carry out the desulfurization process.

DESCRIPTION OF PREFERRED EMBODIMENTS

Figure 1:
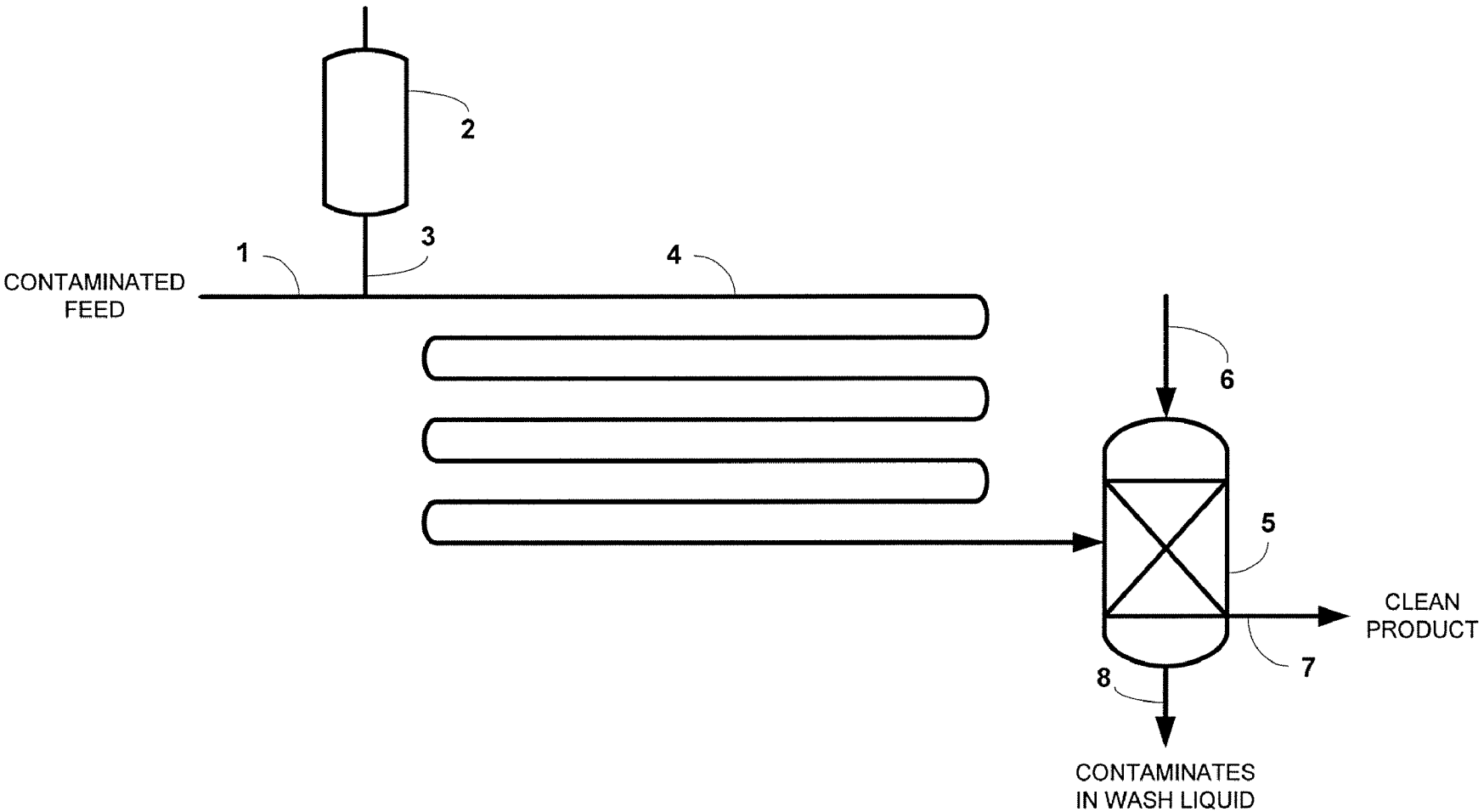
FIG. 1 illustrates a schematic of the process as described in the present application.

The various configurations of this novel hydrocarbon desulfurization process will be understood further with reference to the drawing. In FIG. 1, a liquid feed stream containing organosulfur species is introduced into the system through line 1. Metallic sodiun dissolved in a solvent, preferably, liquid anhydrous ammonia, is contained in feed tank 2. Tank 2 may also contain a hydrogen donor liquid and the combination of these materials is introduced into the feed stream through line 3 at a temperature and pressure so that the solvent remains in the liquid phase. A temperature in the range of about 25° C. is preferred, but temperatures a low as −50° C. could be employed. For the remainder of the description, we will assume that liquid anhydrous ammonia is the solvent.

Sodium is well known to be very soluble in liquid ammonia (U. Schindewolf, *Angew. Chem. Internat. Edit., Vol.* 7 (1968)/No. 3) with solubilities as high as 6 M (approximately 20 wt %) possible. Therefore, the preferred concentration of sodium in ammonia for the present invention is 0.1 to 25 wt %, more preferably 0.5 to 25 wt % and most preferably 1.0 to 20 wt %. The formation of the sodium/ammonia solution can be assisted by using small pieces of sodium metal and using agitation, such as that provided with ultrasonic mixing, to assist in forming the desired solution.

The use of a solvent that can solvate sodium without reacting with the sodium, such as liquid ammonia, is a critical part of the current invention. Another suitable but less preferred solvent is linear or cyclic ethers or certain diamines, such as disclosed in (J. L. Down; J. Lewis; B. Moore and G. Wilkinson; "The Solubility of Alkali Metals in Ethers," J. Chem. Soc., 1959, 3767), hereby incorporated by reference. By introducing the metallic sodium into the hydrocarbon feed as a solution, the problems associated with formation of a sodium sulfide "crust" on molten sodium droplets used in the prior art is mitigated. It is highly desirable that the solvent be anhydrous (i.e., free of water), since water contained in the solvent would react readily with metallic sodium thus forming sodium hydroxide, which is not effective for removal of sulfur from organosulfur species.

The temperature of the solution of sodium in ammonia should be less than approximately 25° C. to minimize the total pressure. Temperatures higher than 25° C. can be employed but require the use of higher pressures in order to maintain the ammonia in the liquid phase. That is, for this process, the ammonia remains substantially in the liquid phase during the process. However, it is desired that the temperatures remain below the critical temperature of ammonia (132.6° C.) since sodium is not as soluble in supercritical ammonia as in liquid ammonia.

The stoichiometric molar ratio of sodium to feed sulfur is 2:1, corresponding to the composition $Na_2S$. However, slightly higher ratios may be needed (such as 2.1:1) to account for inherent inefficiencies in the process, such as some sodium failing to contact an organosulfur molecule. Feed mixed with liquid ammonia/sodium solution is then fed into a reactor vessel 4, which is maintained at a pressure above the vapor pressure of ammonia at the desired operating temperature in order to ensure that all components are in the liquid phase.

The reaction between sodium and organosulfur species occurs readily over a wide range of temperatures and can be shown to be highly thermodynamically favored at all temperatures between 25° C. and 350° C. Dibenzothiophene has been desulfurized by sodium at 150° C. to produce 99% biphenyl as the product (Z. Yu et al., *Energy and Fuels,* 1999, 13, 23-28), while most of the prior art previously cited previously carried out the desulfurization reactions at higher temperatures. However, in the present invention, the reaction between sodium and feed sulfur in the presence of liquid ammonia has been shown to occur at −35° C. Therefore, the preferred range of operating temperatures for desulfurization by the present invention is from −50° C. to 50° C., more preferably from −35° C. to 35° C. and most preferably from 25° C. to 35° C.

For the present invention, preferred reactor residence times range from about 1 minute to 240 minutes, more preferably from about 5 minutes to 120 minutes and most preferably from about 5 minutes to 15 minutes. Longer residence times result in increased capital cost because of the required larger reactor vessels.

Removal of sulfur from organosulfur species is also enhanced by the availability of abstractable hydrogen atoms. Therefore, use of a hydrogen donor solvent (a "solvent" in the sense of the hydrogen donor solvent being substantially miscible in the hydrocarbon feed) could also be utilized, such as tetra-hydrofuran (THF) or tetra-hydronaphthalene (tetralin, or tetra-hydroquinoline (less preferred, as it raises the nitrogen content of product stream).

Desulfurized feed plus ammonia now containing sodium sulfide ($Na_2S$) exits reactor 4 in the liquid phase and is fed to wash column 5. A liquid wash solvent, which may be liquid water or an alcohol such as methanol or ethanol, is injected into the reactor effluent. The wash liquid reacts with excess sodium to produce either sodium hydroxide (from water) or a sodium alkoxide (from an alcohol) and simultaneously extracts the sodium sulfide product of desulfurization as well as the tetrahydrofuran (if used as the donor). The wash fluid is removed such as by decanting, centrifuging, or other separation methods. Hydrocarbon donors like tetralin are sulfur free and would remain with the diesel product which exits the wash vessel through line 7. Wash liquid and contaminants are recovered through line 8 for proper disposal.

The following non-limiting examples demonstrate reduction to practice of the current invention.

EXAMPLE 1

A feed comprising n-hexadecane (to simulate a diesel feed), dodecane (as an internal standard), dibenzothiophene (DBT) and 4, 6-dimethyldibenzothiophene (46 DBT) was prepared. The final sulfur content of the feed was ~75 ppm with ~50 ppm S contributed by DBT and ~25 ppm S contributed by the 46 DBT. Approximately five grams of this feed were added to an Erlynmeyer flask along with a piece of freshly cut sodium weighing approximately 0.14 gram. The mixture was stirred magnetically at room temperature (approximately 25° C.) for 1 hour during which time it was noted that the sodium did not change shape or size. At the end of the run ~25 ml of ethanol were added to consume the remaining sodium, the mixture was centrifuged to separate the phases, and the feed liquid was analyzed for DBT and 46 DBT. Gas chromatographic analysis showed 0% reduction of DBT and <5% reduction of 46 DBT. Therefore, treatment with sodium alone had little or no effect on the sulfur content of the feed.

EXAMPLE 2

Approximately five grams of the feed from Example 1 were added to an Erlynmeyer flask along with 5 grams of tetrahydrofuran (THF) which is known to have some solubility for sodium. Again a piece of sodium weighing approximately 0.09 grams was added and the mixture was stirred magnetically at room temperature (approximately 25° C.) for four hours (four times longer than in Example 1). At the end of the run ~25 ml of ethanol were added to consume the remaining sodium, the mixture was centrifuged to separate the phases, and the feed liquid was analyzed for DBT and 46 DBT. Gas chromatographic analysis showed that the DBT concentration had been reduced by 42% and the 46 DBT by 12% indicating that the simple addition of THF to sodium had little effect on removal of sulfur from the feed.

EXAMPLE 3

Approximately five grams of the feed from Example 1 were added to an Erlynmeyer flask along with 5 grams of tetrahydrofuran (THF) which is known to have some solubility for sodium and 0.97 gram tetraazadodecane (a tetramine that was thought to have a slightly higher solubility for sodium than THF). Again a piece of sodium weighing approximately 0.08 grams was added and the mixture was stirred magnetically at room temperature (approximately 25° C.) for four hours (four times longer than in Example 1) during which time it was noted that the sodium did not change shape or size. At the end of the run ~25 ml of ethanol were added to consume the remaining sodium, the mixture was centrifuged to separate the phases, and the feed liquid was analyzed for DBT and 46 DBT. Gas chromatographic analysis showed that the DBT concentration had been reduced by 78% and the 46 DBT by 53% indicating that the addition of the diamine aided somewhat in the reaction but still produced sulfur reduction that was too slow for commercial interest.

EXAMPLE 4

The present invention was then tested. Approximately five grams of the feed from Example 1 was added to a three-neck round bottom flask along with 5 grams of tetrahydrofuran (THF). The flask was immersed in a cold bath comprising mixed xylenes and dry ice. Gaseous ammonia from a cylinder was condensed into the flask however during this run the amount of ammonia added was not known. Again a piece of sodium weighing approximately 0.08 grams was added and the mixture was stirred magnetically below −35° C. for one hour during which time it was noted that the sodium broke up quickly and dissolved into the ammonia producing a blue solution. At the end of the run the ammonia was vaporized and ~25 ml of methanol were added to consume the remaining sodium, the mixture was centrifuged to separate the phases and the feed liquid was analyzed for DBT and 46 DBT. Gas chromatographic analysis showed that no trace of DBT or 46 DBT could be found within the accuracy of the measurement technique indicating >99% reduction in sulfur for both species in 1 hour.

EXAMPLE 5

A new feed was then prepared comprising THF containing docdecane (internal standard), DBT (50 ppm S) and 46 DBT (25 ppm S). THF was used instead of hexadecane, since the hexadecane in Example 4 has solidified at −35° C. and the effect on the reaction was unknown. Approximately three grams of this new feed were added to a Pyrex cold trap and suspended in the cold bath from Example 4. Approximately 3 mls of liquid ammonia were condensed into the trap. A piece of sodium weighing approximately 0.06 grams was added and the mixture was stirred at a temperature below −35° C. using ammonia gas bubbling through the mixture for one hour during which time it was noted that the sodium broke up quickly and dissolved into the ammonia producing a blue solution. At the end of the run the ammonia was vaporized and ~25 ml of methanol were added to consume the remaining sodium; and the feed liquid was analyzed for DBT and 46 DBT. Gas chromatographic analysis showed that no trace of DBT or 46 DBT could be found within the accuracy of the measurement technique indicating >99% reduction in sulfur for both species in 1 hour.

EXAMPLES 6 and 7

Example 5 was repeated but changing the run times to 30 minutes and 15 minutes respectively. After an identical workup, it was found that no trace of DBT or 46 DBT could be found in either example within the accuracy of the measurement technique indicating >99% reduction in sulfur for both species in 30 and 15 minutes. This indicated an extremely fast reaction for sulfur removal for the present invention.

Figure 2:
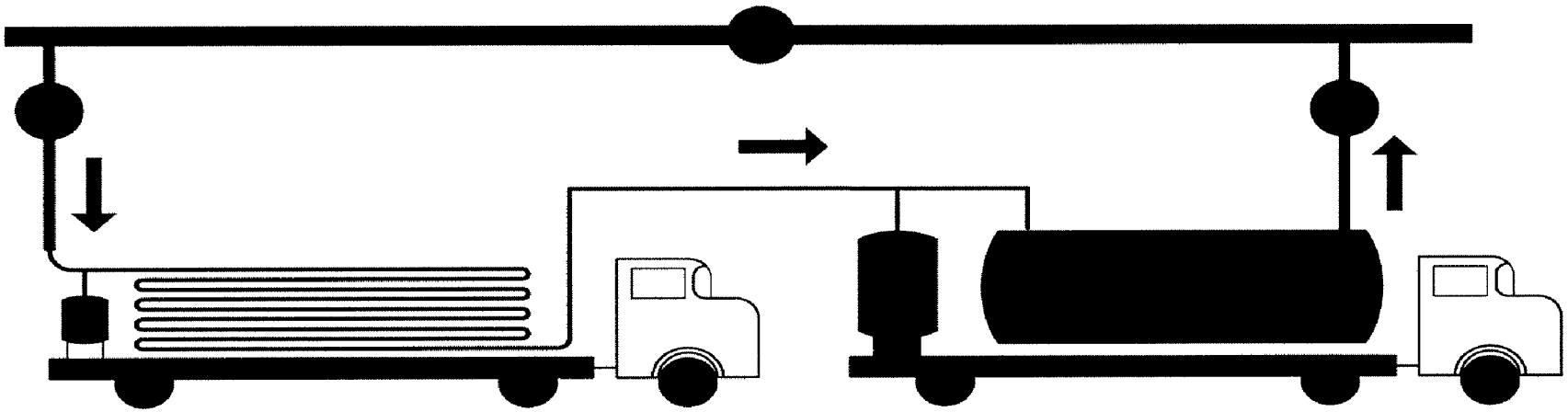
FIG. 2 illustrates a schematic of a truck/skip mounted process equipment.

This process can be carried out in a compact process apparatus that can be skid mounted or truck mounted. For instance, a tubular reactor vessel can be mounted on a process truck as shown in the FIG. 2. Needed are a source of solvent (anhydrous liquid ammonia) and sodium, these sources can be provided from tanks located on the process truck or skid or on a separate skid or truck. Also needed are pumps and metering devices (not shown) to mix the sodium and solvent together to form the liquid additive. The feed is combined with the solvate in the reactor vessel. Suitable reactor design is known to those skilled in the art, process conditions that govern the design include temperature, pressure, feed rates and residence times. Additional equipment that may be required to achieve the desired process environment (pressure and temperature). Finally, mixers, such as static mixers mounted in the reactor vessel, may be included in the vessel to mix the solvate with the feed, Liquid effluent would then be sent (via piping) to a second truck that would do the washing and would collect the water stream containing contaminants. Cleaned product would then exit to the storage tanks.

I claim:

1. A method of removing sulphur from a hydrocarbon feed stream, comprising the steps of:

(a) dissolving sodium in a liquid solvent to form a solution containing sodium atoms;

(b) combining the liquid solution from step (a) with a liquid hydrocarbon feed containing an organosulfur component to form a combined stream at a temperature of addition and at a pressure near or above the vapor pressure of the solvent at the temperature of addition;

(c) reacting the combined stream for sufficient reaction time and at sufficient reaction temperature to form a modified composition comprising one or more sulfur-containing species and less of the organosulfur species than had been present in the hydrocarbon feed;

(d) extracting a portion of the sulfur-containing species from the modified composition.

2. The method of claim 1 wherein the extraction step includes the step of washing the modified composition with a second solvent.

3. The method of claim 1 where the solvent is anhydrous.

4. The method of claim 3 where the solvent is ammonia.

5. The method of claim 1 wherein the reaction temperature is in the range of about −50 C to about 132.6 C.

6. The method of claim 1 wherein the temperature of addition is less than 132.6 C.

7. The method of claim 6 wherein the temperature of addition is less than about 35 C.

8. The method of claim 1 wherein the reaction time is in the range of about 0.1 minute to about 240 minutes.

9. The method of claim 1 wherein the reaction takes place in the presence of a hydrogen donor.

10. The method of claim 9 wherein the hydrogen donor is added to the solution of sodium atoms.

11. The method of claim 9 wherein the hydrogen donor is added to the hydrocarbon stream or to the combined stream.

12. The method of claim 2 wherein the second solvent comprises water or an alcohol.

13. The method of claim 1 wherein the step of reacting (step b) is undertaken in a reaction vessel.

14. The method of claim 13 wherein said reaction vessel comprises a tubular reactor vessel.

15. The method of claim 13 wherein said reactor vessel is positioned on a movable vehicle.

16. The method of claim 13 wherein the step of extraction (step d) is undertaken in an extraction vessel.

17. The method of claim 13 wherein the extraction vessel is separate from the reaction vessel.

18. The method of claim 16 wherein the extraction vessel is positioned on a movable vehicle.

* * * * *